US005349574A

United States Patent [19]

Edwin et al.

[11] Patent Number: 5,349,574

[45] Date of Patent: Sep. 20, 1994

[54] HOROLOGICAL MOVEMENT HAVING GUIDE MEANS FOR A CONTROL MEMBER SUCH AS A SHAFT

[75] Inventors: Jakob Edwin, Granges, Switzerland; Siegfried Grau, Pforzheim, Fed. Rep. of Germany

[73] Assignee: ETA S.A. Fabriques D'Ebauches, Granges, Switzerland

[21] Appl. No.: 37,427

[22] Filed: Mar. 26, 1993

[30] Foreign Application Priority Data

Apr. 2, 1992 [CH] Switzerland ..... 01076/92-4

[51] Int. Cl.[5] ..... G04B 19/24

[52] U.S. Cl. ..... 368/190; 368/191; 368/192

[58] Field of Search ..... 368/185, 190–195

[56] References Cited

U.S. PATENT DOCUMENTS

| | | | |
|---|---|---|---|
| 3,444,462 | 5/1969 | Tarcy-Hornoch | 368/120 |
| 3,733,800 | 5/1973 | Maeda et al. . | |
| 4,274,152 | 6/1981 | Ikegami | 368/192 |
| 4,548,514 | 10/1985 | Ganter | 368/291 |
| 4,610,550 | 9/1986 | Thomke et al. . | |
| 4,727,523 | 2/1988 | Morata | 368/191 |
| 4,862,434 | 8/1989 | Hiraga et al. | 368/190 |

FOREIGN PATENT DOCUMENTS

| | | |
|---|---|---|
| 0131858 | 1/1985 | European Pat. Off. . |
| 2143676 | 2/1973 | France . |
| 5616 | 9/1892 | Switzerland . |
| 9012 | 7/1906 | Switzerland . |
| 37042 | 7/1906 | Switzerland . |

*Primary Examiner*—Bernard Roskoski
*Attorney, Agent, or Firm*—Pollock, Vande Sande & Priddy

[57] ABSTRACT

The instant invention relates to a horological movement provided with shaft guide means.

This movement has horometric means (H) capable of supplying a time information and at least one control member (34) composed of the shaft and adapted to act on the horometric means (H), this control member (34) being guided axially and/or in rotation by the intermediary of guide means, this movement also being characterized in that said guide means are composed of three guide pieces (38, 40, 42) mounted and maintained sandwiched on one another to form therebetween a seating in which the control member (34) is freely received.

9 Claims, 2 Drawing Sheets

HOROLOGICAL MOVEMENT HAVING GUIDE MEANS FOR A CONTROL MEMBER SUCH AS A SHAFT

FIELD OF THE INVENTION

The instant invention relates to a horological movement having, on the one hand, horometric means formed by gear trains adapted to supply a time information and, on the other hand, of at least one control member, such as a shaft, adapted to act on these horometric means.

In particular the invention relates to a horological movement of the above-mentioned type provided with means designed to permit guidance of the shaft.

DESCRIPTION OF THE PRIOR ART

In conventional horological movements the control shaft is generally guided by means of its free extremity which is lodged in a guide orifice provided in a plate of the movement.

The guide orifice is formed by a lateral drilling provided directly in the plate.

This drilling is expensive to make since it requires several handling operations as well as machining work that is lengthy and must be very precise.

OBJECTS OF THE INVENTION

It is thus an object of the instant invention to overcome the disadvantages of the prior art by providing a movement having shaft guide means which are easy to produce and of a very low cost.

BRIEF SUMMARY OF THE INVENTION

It is thus an object of the invention to provide a horological movement having horometric means capable of supplying a time information and at least one control member adapted to act on these means, this control member being guided axially and/or in rotation by the intermediary of guide means, characterized in that the said guide means are composed of three guide pieces (38, 40, 42) mounted and maintained sandwiched on one another to form therebetween a seating in which said control member is freely received.

DETAILED DESCRIPTION OF THE INVENTION

Figure 1:
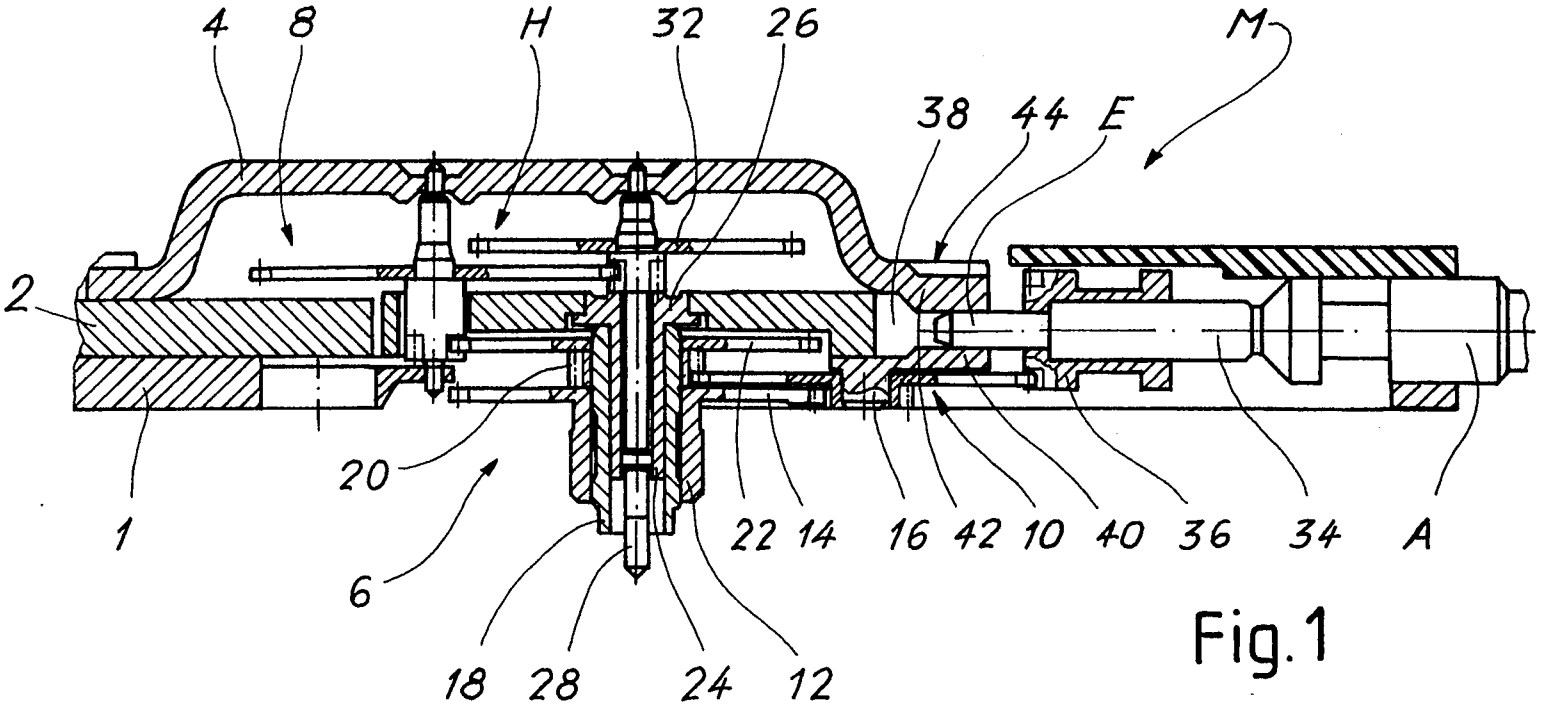
Figure 2:
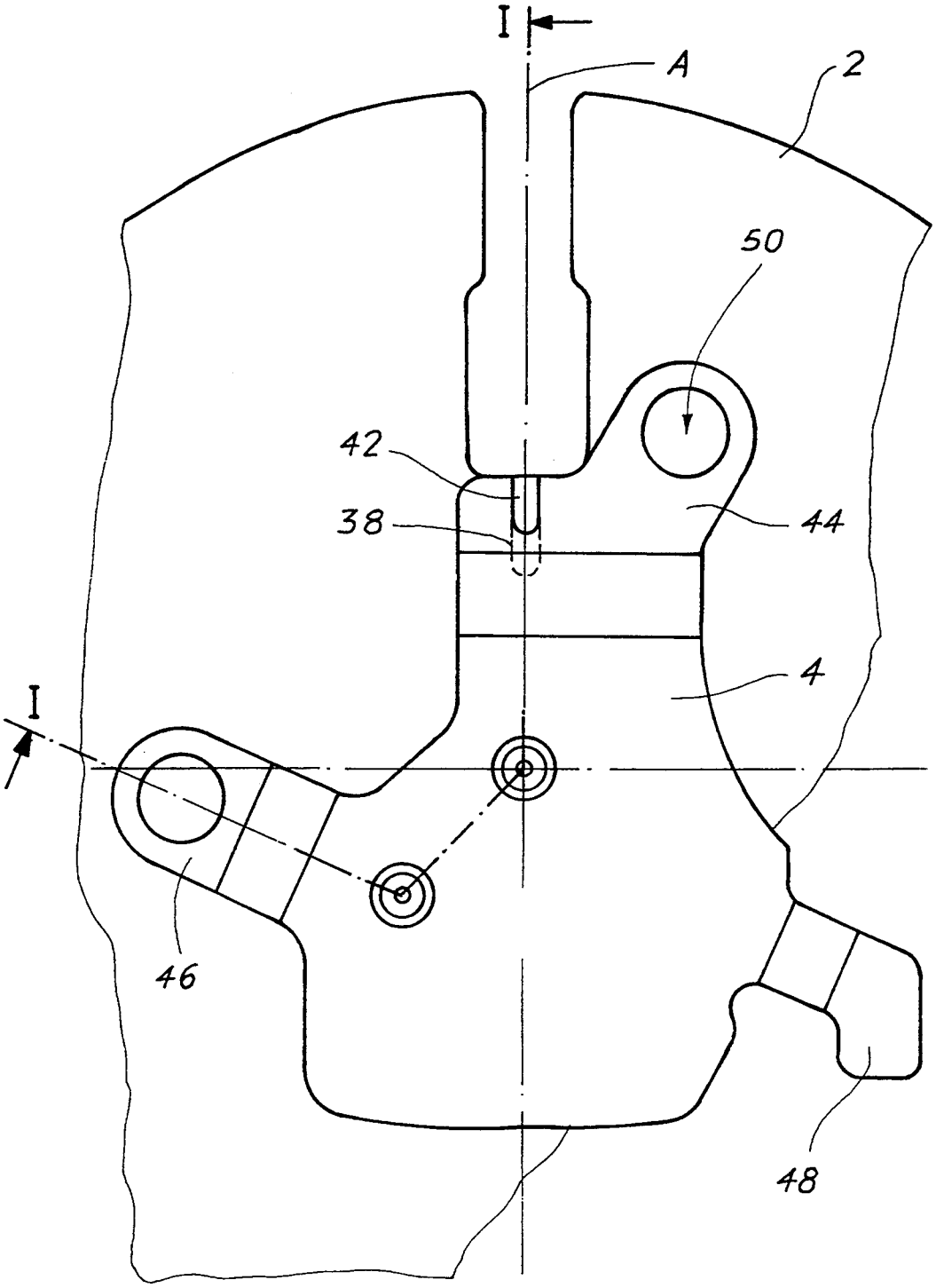

Other features and advantages of the invention will emerge from study of the following detailed description provided with reference to the appended drawings which are given solely by way of example, in which:

FIG. 1 is a cross section of a horological movement of the invention shown in part herein, this view being taken along the line I—I of FIG. 2; and FIG. 2 is a plan view taken along the arrow II of FIG. 1, but only showing one train bar and one bar of the centre of the movement of the invention.

DETAILED DESCRIPTION OF THE INVENTION

As shown in FIG. 1, the movement of the invention which is indicated with the general reference M has a plate 1, a center bar 2 and a train bar 4 which support horometric means H able to supply a time information, such as the hours, the minutes and in this example the second.

The horometric means H have a certain number of trains composed respectively of a motion-work 6, an intermediate seconds wheel 8 and a dial-train wheel 10.

The motion-work 6 has an hours cylinder 12 having a wheel 14 meshing with the dial-train wheel 10 which is mounted directly on a post 16 provided on the plate 1.

The motion-work 6 also has a canon-pinion 18 which carries the hours cylinder 12 and which comprises, driven thereon on the one hand a minute pinion 20 meshing with the dial-train wheel 10 and, on the other hand, a minutes wheel 22 meshing with the seconds countershaft 8.

The canon-pinion 18 is moveably mounted in rotation on a fixed canon 24, the seating 26 of which is driven into the center bar 2.

The center bar 2 thus ensures the support of the hours cylinder 12 and of the canon-pinion 18 by means of the fixed canon 24.

The train 6 also comprises a seconds staff 28 which is also supported by the center bar 2 by being rotatably lodged in the fixed canon 24.

The seconds staff 28 is in addition guided by the train bar 4 in which it is rotatably mounted.

Driven onto the seconds staff 28 is a seconds pinion 30 meshing with the seconds countershaft 8, and a drive wheel 32 engaged with the motor means of the movement M (not shown).

It will also be noted that the seconds countershaft 8 is guided by the train bar 4 and by the plate 1 between which it is freely mounted in rotation.

The movement M of the invention also has a hand-setting shaft 34 forming a control member adapted to act on horometric means H in conventional manner.

Also mounted on this shaft 34 in conventional manner is a sliding pinion 36 capable of meshing with the dial-train wheel 10 which serves here as the hand-setting countershaft. The shaft 34 is adapted to be able to move axially along a geometric axis A as well as in rotation about this axis. The invention is not limited to a control member of this type and can be applied to control members which only present either an axial displacement or a displacement in rotation.

The shaft 34 has a free extremity E which is guided by the plate 1, by the center bar 2 and by the train bar 4.

As can be seen in FIG. 2, the center bar 2 which forms an intermediary part between the two other parts 1 and 4 has a opening groove 38 oriented along the geometric control axis A and in which the free extremity E is lodged and can travel.

This groove 38 ensures the lateral guidance of the free extremity E which is, in addition, confined on both sides by the train bar 4 and by the plate 1.

For this purpose the plate 1 and the train bar 4 have bosses 40 and 42 respectively which project into the groove 38.

It will be noted (FIG. 2) that the center bar 4 is composed of a dished part with three feet 44, 46 and 48 provided thereon.

The feet 44 and 46 rest directly on the center bar 2 and are fixedly maintained thereon whereas the foot 48 rests directly on the plate 1 (not shown in FIG. 2).

It will be noted that the boss 42 is provided on the foot 44, near the anchorage point 50 which fixes the train bar 4 to the center bar 2.

The bosses 40 and 42 are provided near the edges of the train bar 4 and of the plate 1 respectively.

It will thus be understood that the free extremity E of the shaft 34 is lodged and retained between the train bar 4 and the plate 1, but also in the center bar 2 which is sandwich mounted between the train bar 4 and the plate 1.

The train bar 4, the center bar 2 and the plate 1 form three guide parts mounted and sandwiched against each other to form a seating therebetween in which the control member 34, and more particularly its free extremity E, is freely received.

More precisely, by virtue of their function as bar or plate, these three guide parts 1, 2 and 4 also form supports for the rotation of at least one train 6, 8 or 10 belonging to the horometric means H.

It will thus be understood that guide means of the control member 34 have been created which are of low cost and which require no precise machining of the material or any additional handling operation.

What is claimed is:

1. A horological movement comprising horometric means for supplying a time information, and guide means for guiding in at least one of axial and rotational movements at least one control member adapted to act on the horometric means, said guide means comprising two opposite guide parts and a third guide part forming an intermediary center bar mounted and sandwiched between the two opposite guide parts to form therebetween a seating for freely receiving said control member, said horometric means comprising at least one staff supported by said intermediary center bar, and one of said opposite guide parts forming a train bar for guiding said at least one staff of the horometric means.

2. A movement according to claim 1 wherein said horometric means further comprises at least one train, and wherein the intermediary center bar and the opposite guide parts form supports for rotatably mounting said at least one train of the horometric means.

3. A movement according to claim 1 wherein the intermediary center bar has a groove opening which is oriented along the axis of the control member and which guides the control member laterally.

4. A movement according to claim 3 wherein said intermediary center bar insures the support of a motionwork.

5. A movement according to claim 3 wherein the train bar and the other of said guide parts each have a boss which penetrates the groove opening of the intermediary center bar.

6. A movement according to claim 5 wherein said train bar comprises a dished part having a plurality of positioning feet at least one of which rests directly on the intermediary center bar, and wherein the boss on said train bar is provided on one of said feet.

7. A movement according to claim 1 wherein said train bar comprises a dished part having a plurality of positioning feet at least one of which rests directly on the intermediary center bar.

8. A movement according to claim 7 wherein the other of said opposite guide parts forms a plate, and wherein said dished part is provided with three of said positioning feet at least one of which rests directly on the plate.

9. A movement according to claim 1 further comprising said control member, and wherein said control member comprises a handsetting shaft adapted to act on said horometric means, said handsetting shaft supporting a sliding pinion and having a free extremity which is guided by said guide means.

* * * * *